US005371434A

United States Patent [19]

Rawlings

[11] Patent Number: 5,371,434

[45] Date of Patent: Dec. 6, 1994

[54] RADIATION-EMITTING DEVICES HAVING AN ARRAY OF ACTIVE COMPONENTS IN CONTACT WITH A FLUORESCENT LAYER

[75] Inventor: Keith C. Rawlings, Cheltenham, United Kingdom

[73] Assignee: Smiths Industries Public Limited Company, London, England

[21] Appl. No.: 22,159

[22] Filed: Feb. 23, 1993

[30] Foreign Application Priority Data

Apr. 7, 1992 [GB] United Kingdom ..... 9207524

[51] Int. Cl.[5] ..... H01J 1/62

[52] U.S. Cl. ..... 313/506; 313/505; 313/509; 313/512; 315/169.3; 345/30; 345/32; 345/80; 345/76; 345/82

[58] Field of Search ..... 313/506, 505, 509, 512; 315/169.3; 345/30, 32, 80, 76, 82

[56] References Cited

U.S. PATENT DOCUMENTS

| | | | |
|---|---|---|---|
| 3,385,992 | 5/1968 | Chaberski | 315/169.3 |
| 3,976,877 | 8/1976 | Thillays | 313/512 |
| 4,047,075 | 9/1977 | Schoberl | 313/512 |
| 4,578,615 | 3/1986 | Genovese et al. | 345/32 |
| 4,599,537 | 7/1986 | Yamashita | 313/512 |
| 5,043,716 | 8/1991 | Latz et al. | 345/82 |
| 5,066,889 | 11/1991 | Edwards | 313/512 |
| 5,258,690 | 11/1993 | Leksell et al. | 313/512 |

FOREIGN PATENT DOCUMENTS

| | | | |
|---|---|---|---|
| 458270 | 11/1991 | European Pat. Off. | 345/32 |
| 2617664 | 1/1989 | France | 313/512 |
| 2108093 | 4/1990 | Japan | 345/32 |
| 2115889 | 4/1990 | Japan | 345/32 |
| 3194588 | 8/1991 | Japan | 345/32 |
| 175735 | 6/1961 | Sweden | 313/506 |
| 2252857 | 8/1992 | United Kingdom . | |
| 8000106 | 1/1980 | WIPO | 345/32 |

OTHER PUBLICATIONS

Lester Eastman, "Comparison of vacuum and semiconductor field effect transistor performance limits", Vacuum Microelectronics 1989, pp. 189–194.

*Primary Examiner*—Michael Horabik
*Assistant Examiner*—Matthew J. Esserman
*Attorney, Agent, or Firm*—Pollock, VandeSande and Priddy

[57] ABSTRACT

A display or other radiation-emitting device has an array of vertical ballistic transistors which produce electrons that flow into overlying phosphor regions. Light produced by the phosphors is focussed by an array of convex lenses above the phosphor regions to provide a high intensity display with limited viewing angle.

12 Claims, 3 Drawing Sheets

RADIATION-EMITTING DEVICES HAVING AN ARRAY OF ACTIVE COMPONENTS IN CONTACT WITH A FLUORESCENT LAYER

BACKGROUND OF THE INVENTION

This invention relates to radiation-emitting devices.

Currently available radiation-emitting devices, such as a display, take various different forms. In cathode-ray tube displays (CRT's) electrons produced by a source are accelerated by an applied voltage across a vacuum onto a phosphor screen. The beam of electrons is scanned over the screen magnetically or electrostatically, to produce the desired display representation. CRT's suffer from various disadvantages. They require high drive voltages, they are relatively bulky and are not very robust.

Alternative displays generally comprise a matrix array of light-emitting or reflecting devices, such as light-emitting diodes or liquid crystal elements. These can provide more compact and robust displays than CRT's but also suffer from various disadvantages such as relatively slow response times, lower resolution, reduced visibility or limited viewing angle.

In GB 2252857 there is described a solid-state display comprising a glass plate on which is deposited an upper layer of parallel conductive tracks interrupted by recesses containing a conductive or semiconductive phosphor. An array of vertical ballistic transistors within a semiconductor layer is in alignment on one side with the phosphor regions and on the other side with respective conductive tracks which extend at right angles to the tracks in the upper layer. When a voltage is applied to one of the tracks in the upper layer which is positive with respect to the voltage applied to one of the lower tracks, it causes one of the transistors to emit electrons upwardly into the phosphor region. This causes fluorescence of the region and the emission of light.

While this form of display can be used satisfactorily for normal viewing by the unaided eye, there are circumstances where an improved resolution and maximum radiation flux are required such as, for example, where images need to be formed in printing devices.

BRIEF SUMMARY OF THE INVENTION

It is an object of the present invention to provide an improved form of radiation-emitting device.

According to one aspect of the present invention there is provided a radiation-emitting device including a first layer containing a fluorescent material, an array of electron-emitting active components mounted in contact with the layer arranged such that energization of a component causes electrons to be emitted into the layer of fluorescent material to excite the layer adjacent the component to produce radiation, and an array of converging radiation focussing means located above the layer of fluorescent material in alignment with the electron-emitting active components such that emitted radiation is focussed by the focussing means.

The radiation focussing means are preferably convex regions of radiation-transparent material such as of a transparent plastics, for example, polycarbonate. The device may include a layer of transparent material with a flat surface formed over the focussing means, the layer having a refractive index that is less than that of the material of the focussing means. The radiation focussing means may be tinted and may include an anti-reflection coating. The radiation focussing means may include a diffraction grating.

The focussing means may be formed by first depositing a layer of uniform thickness and then removing parts of the layer to form the focussing means. Alternatively, a transparent material may be applied as fluid droplets which set to form a convex surface by their surface tension.

The fluorescent material in the first layer may be arranged in an array of discrete regions of fluorescent material aligned with the active components. Different ones of the discrete regions may be of different fluorescent materials such that optical radiation emitted from the different regions are of different colors. Each discrete region of fluorescent material may be aligned with a plurality of adjacent active components which are arranged to emit electrons into the same region. The first layer may be of electrically-conductive material and preferably comprises a plurality of parallel electrically-conductive tracks, the discrete regions of fluorescent material being located at a plurality of locations along the length of each track. The device preferably includes a lower layer of electrically-conductive tracks insulated from the first layer, the tracks in the lower layer extending at right angles to the tracks in the first layer and being electrically connected to the electron-emitting active components such that individual ones of the active components can be caused to emit electrons by applying a voltage between appropriate ones of the tracks in the first and lower layers. The device preferably includes an intermediate layer of semiconductive material, the active components being formed within the intermediate layer. The cross-sectional area of the active components may be larger adjacent the first layer than remote from the first layer. The active components may be vertically-oriented field-effect transistors such as ballistic transistors. The fluorescent material is preferably a phosphor and may include an electrically-conductive or semi-conductive material.

According to another aspect of the present invention there is provided a display including a device according to the above one aspect of the present invention.

According to a further aspect of the present invention there is provided a printer including a device according to the above one aspect of the present invention.

A device in the form of a display, according to the present invention, will now be described, by way of example, with reference to the accompanying drawings.

DESCRIPTION OF THE PREFERRED EMBODIMENTS

Figure 1:
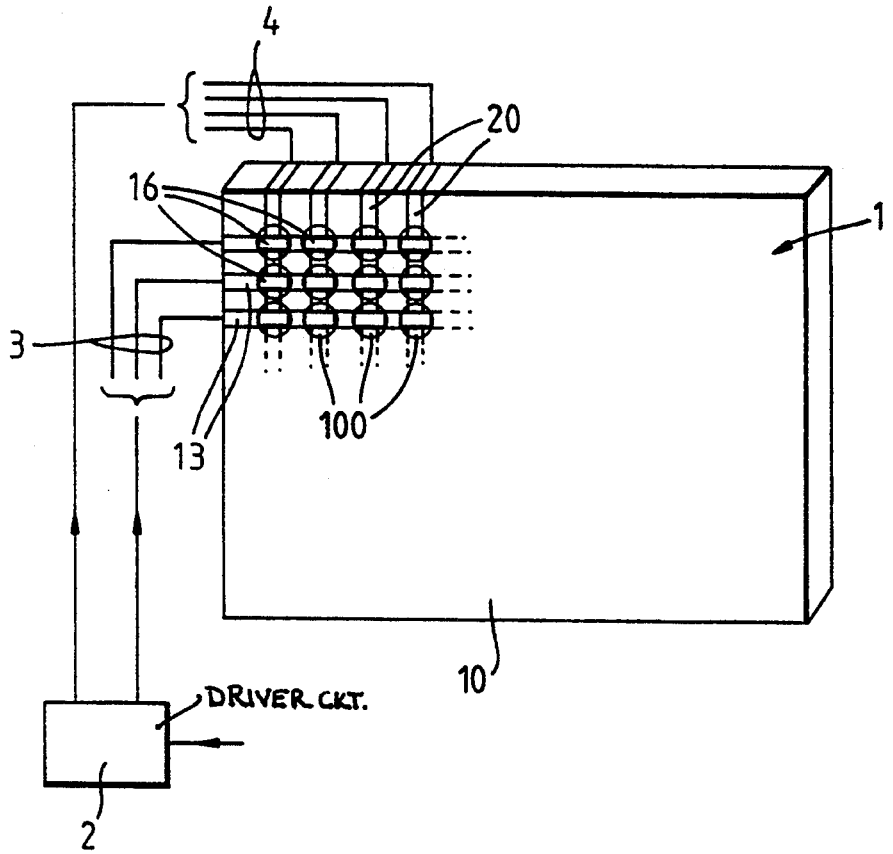
FIG. 1 is a perspective view of the display.
Figure 2:
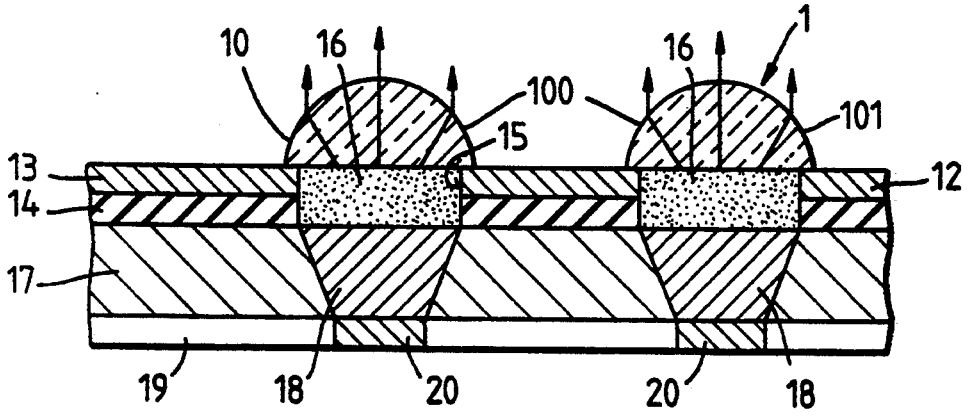
FIG. 2 is a sectional view of a part of the display to an enlarged scale.

The display is in the form of a multi-layer flat panel 1 connected to a driver circuit 2 via conductors 3 and 4.

The panel 1 comprises an upper lenticular layer 10, facing the viewer of the display. The lenticular layer 10 comprises an array of convex, converging, focussing lenses 100 of an optically-transparent plastics material, such as a polycarbonate. Each lens 100 is of substantially hemispherical shape. The material of the lenses 100 may be tinted to improve visibility or to modify the color of the display as desired. An anti-reflection coating 101 may be formed on the upper surface 11 of the lenses 100. Beneath the lenticular layer 10 there is a first, upper electrically-conductive electrode layer 12, which takes the form of closely-spaced parallel metal tracks 13 extending across the width of the panel 1 between opposite edges. At one edge, the metal tracks 13 are connected to respective ones of the conductors 3. The metal tracks 13 are insulated on their lower surface by an insulating layer 14.

At regular intervals along their length, apertures 15 are formed through the metal tracks 13 and the insulating layer 14. The size of the apertures 15 is slightly less than the width of each track so that the tracks 13 conduct along their entire length. A fluorescent material 16, such as a phosphor, is deposited in the apertures 15 to form discrete phosphor regions within the layer 12 which align with respective ones of the lenses 100. The apertures 15 may be of rectangular, square, circular, hexagonal or other shape, the phosphor regions 16 appearing, when viewed from above, as a closely-packed orthogonal array of dots or short stripes.

Below the insulating layer 14 is deposited an intermediate layer 17 of a semiconductor material such as silicon. The semiconductor layer 17 is interrupted by an array of vertically-oriented field-effect or ballistic transistors 18, or other active components capable of generating high energy electrons. Ballistic transistors are a variant of field-effect transistors and their construction is well known, such as described in "Comparison of vacuum and semiconductor field effect transistor performance limits", Lester F. Eastman, Vacuum Microelectronics 89, R. E. Turner (ed), Institute of Physics, 1989, pp 189–194. The transistors consist of multiple layers and may be silicon or, preferably, gallium arsenide. The transistors 18 are arranged in rows and columns in alignment and contact with the phosphor regions 16.

On the lower surface of the panel 1 there is formed a second, lower electrically-conductive layer 19 in the form of closely-spaced parallel metal tracks 20. The lower tracks 20 lie at right angles to the upper tracks 13 and extend up the height of the panel 1 between opposite edges, being aligned with different ones of the transistors 18 along each row. At one edge, the tracks 20 are connected to respective ones of the conductors 4.

The drive circuit 2 may be of any conventional form used to drive conventional matrix array displays, such as employing various multiplexing techniques. Alternatively, distributed processors could be used, such as described in U.S. Pat. No. 5,041,993.

A display representation is provided by applying a suitable voltage across appropriate ones of the ballistic transistors 18. Any individual one of the ballistic transistors 18 can be energized by applying voltage between one of the conductors 3, to select the desired row or track 13, and one of the conductors 4, to select the desired column or track 20. The voltage applied to the conductors 3, and hence the upper electrode layer 12, is more positive than that applied to the conductors 4, and hence the lower electrode layer 19.

Figure 3:
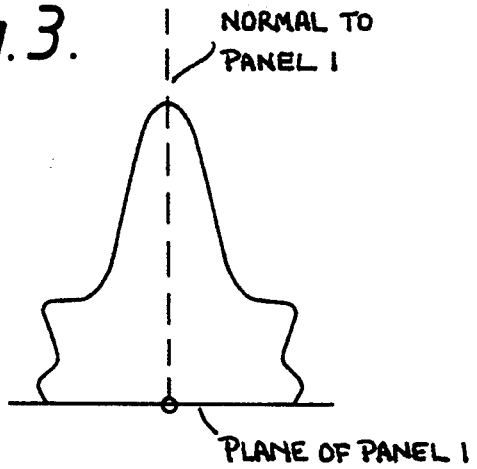
FIG. 3 is a polar diagram of light emission from a display element.
Figure 4:
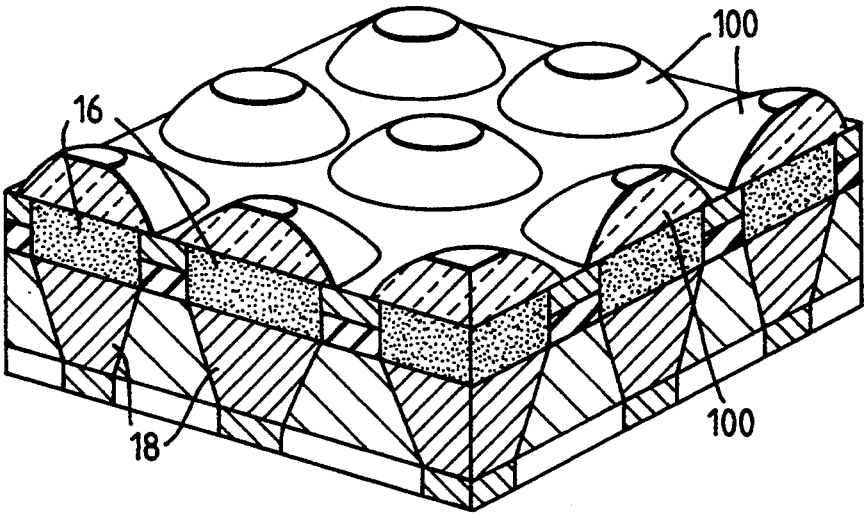
FIG. 4 is an enlarged perspective view of a part of the display.

When the desired transistor 18 is addressed it is caused to emit high energy electrons which flow vertically upwardly towards the upper electrode layer 12. A portion of the electrons produced flow into the phosphor regions 16 with a sufficiently high energy to cause fluorescence and the emission of optical radiation. The radiation produced is focussed, by refraction or phase interference, by the lenses 100 to give a unidirectional emission preferentially along an axis normal to the plane of the panel, as shown in the polar diagram in FIG. 3. This uni-directional emission is not generally desirable in displays that are to be viewed by the unaided eye because the angle over which the display can be viewed is severely limited. However, by confining the emitted radiation to a narrow angle, its intensity is increased and the resolution is improved. This can be an advantage where a high intensity display is required and where the narrow viewing angle is not a problem.

By forming the lenses 100 of different, asymmetrical shape, radiation can be directed along an axis away from the normal to the panel. The orientation of the focal axes of some of the lenses could be different so that radiation from selected regions of the display is directed in different directions.

The optical radiation emitted by a phosphor region 16 appears as a bright spot. By varying the voltage applied across the ballistic transistors 18, the electron energy can be varied and hence the apparent brightness of the phosphor region 16. Each transistor 18 is preferably tapered through the depth of the semiconductor layer 17, so that its cross-sectional area in the plane of the semiconductor layer is larger adjacent the phosphor material 16 and the first layer 12 than remote from the first layer 12, adjacent the other electrode layer 19. In this way, the spacing between adjacent phosphor regions 16 can be kept to a minimum for a given spacing between the ballistic transistors 18. It may be necessary to use several transistors for each pixel in order to increase the brightness of the display. In such an arrangement adjacent ones of the transistors would be aligned with a common one of the discrete phosphor regions so that the electrons emitted by the transistors flow into the same phosphor region.

The display has the advantage that it is solid-state without any vacuum chamber and therefore can be rugged and compact. The ballistic transistors 18 are fast acting compared with, for example, liquid crystal elements, so that the display is particularly suited for representing rapidly changing images. The different layers of the panel 1 can be deposited by conventional screen printing and photolithographic processes well known in the manufacture of integrated circuits.

Although the display described above only provides a monochrome image, color images can readily be produced, either by using three different phosphors that emit radiation in the red, green and blue parts of the spectrum, or by applying red, green and blue filters between the upper surface of the phosphor regions 16 and the lenticular layer 10.

The phosphor may include a material to render it electrically conductive or semiconductive so that the voltage applied between the tracks 13 and 20 causes a direct flow of electrons into the phosphor region.

The lenticular layer 10 may be formed in various different ways. One way is to deposite a layer of uniform thickness across the entire surface of the panel and then to remove parts of the layer, such as by photoresist chemical etching, to form the desired lenticular pattern. Another way is to apply the material in a fluid condition as droplets so that surface-tension effects achieve the lenticular shape.

Figure 5:
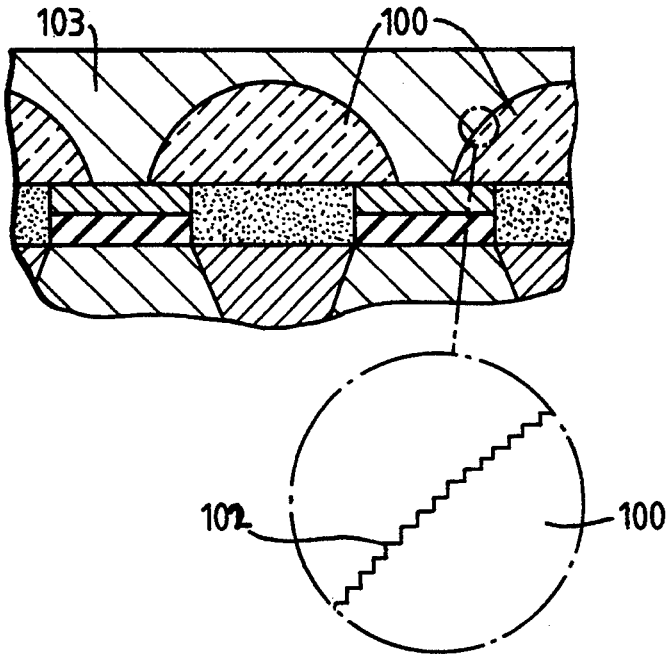
FIG. 5 is a sectional view of a part of an alternative display.

The surface of each lens 100 may be formed with a diffraction grating 102, as shown in FIG. 5. This Figure also shows the use of an additional, transparent fill-in layer 103 which covers the lenses 100 to form a flat upper surface to the panel 1. The material of the layer 103 has a lower refractive index than the material of the lenses 100.

Figure 6:
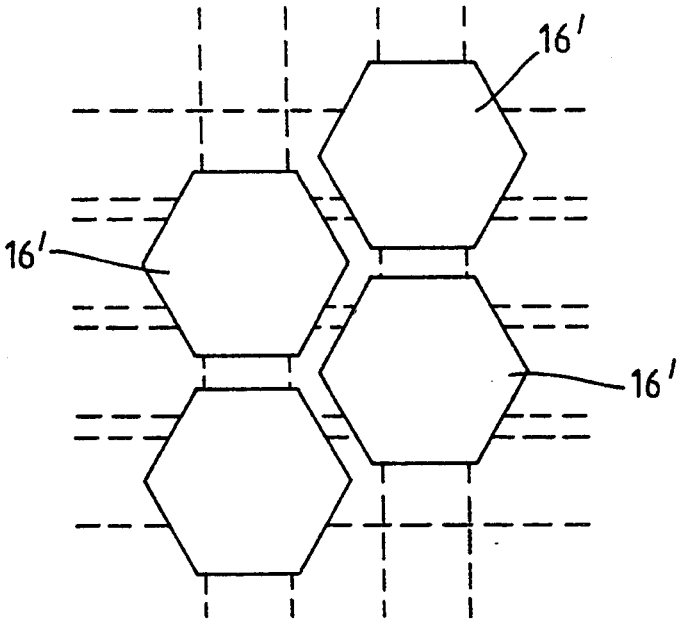
FIG. 6 shows a further modification of the display.

Different arrays of the phosphor regions and ballistic transistors are possible, such as that shown in FIG. 6 where the phosphor regions 16' are of hexagonal shape and arranged in a cubic close packed configuration.

Alternatively, where the display is only required to be used for representing one symbol or legend, or a limited number of them, the phosphor regions need only be located in regions coinciding with that symbol or legend. A more simplified drive circuit could be used for such an arrangement.

The present invention is not confined to displays or to optical radiation. For example, the invention could be used to provide a high intensity radiation image for use in a printer, for addressing radiation-responsive devices or radiation-retentive storage devices. Within the optical radiation band, the emission layer may be a silicon germanium superlattice for the production of ultraviolet radiation, or a zinc sulphide phosphor for infra-red radiation. Other chemical compositions could be used to produce other radiation, such as in the x-ray band where high energy electrons are formed.

What I claim is:

1. A radiation-emitting device comprising: a first layer containing a fluorescent material; an array of electron-emitting active components; means mounting the array of electron-emitting active components in contact with the first layer such that energization of one of said components causes electrons to be emitted into the first layer to excite the first layer adjacent the component to produce radiation; and an array of converging radiation focussing means located above the first layer in alignment with the electron-emitting active components such that emitted radiation is focussed by the focussing means.

2. A device according to claim 1, wherein the radiation focussing means are convex regions of radiation-transparent material.

3. A device according to claim 2, wherein the radiation-transparent material is of a transparent plastics.

4. A device according to claim 2, including a layer of transparent material with a flat surface formed over the focussing means, and wherein the layer of transparent material has a refractive index that is less than that of the material of the focussing means.

5. A device according to claim 1, wherein the radiation focussing means are tinted.

6. A device according to claim 1, wherein the radiation focussing means include an anti-reflection coating.

7. A device according to claim 1, wherein the radiation focussing means include a diffraction grating.

8. A device according to claim 1, wherein the fluorescent material in said first layer is arranged in an array of discrete regions of fluorescent material aligned with the active components.

9. A device according to claim 8, wherein different ones of the discrete regions are of different fluorescent materials such that optical radiation emitted from the different regions are of different colors.

10. A device according to claim 1, wherein the active components are vertically-oriented field-effect transistors.

11. A device according to claim 1, wherein the active components are vertically-oriented ballistic transistors.

12. A display comprising: a first layer, said first layer including an array of discrete regions of fluorescent material; an array of electron-emitting active components; means mounting the array of electron-emitting active components in contact with the first layer with each component aligned with a respective fluorescent region such that energization of one of said components causes electrons to be emitted into the overlying fluorescent region to produce radiation; and an array of converging lenses above the first layer with each lens aligned with a respective one of the fluorescent regions such that radiation emitted by the fluorescent regions is focussed by respective ones of said lenses.

* * * * *